United States Patent [19]

Speranza

[11] Patent Number: 4,640,511

[45] Date of Patent: Feb. 3, 1987

[54] BOWLING BALL RETURN MECHANISM

[75] Inventor: Daniel R. Speranza, Westerville, Ohio

[73] Assignee: AMF Incorporated, White Plains, N.Y.

[21] Appl. No.: 676,114

[22] Filed: Nov. 29, 1984

[51] Int. Cl.[4] ..... A63D 5/02

[52] U.S. Cl. ..... 273/49

[58] Field of Search ..... 273/49

[56] References Cited

U.S. PATENT DOCUMENTS

| | | | |
|---|---|---|---|
| 2,699,944 | 1/1955 | Keesling | 273/49 |
| 2,964,318 | 12/1960 | Levendoski | 273/49 |
| 3,098,653 | 7/1963 | Gruss et al. | 273/43 R |
| 3,479,029 | 11/1969 | Zuercher et al. | 273/49 |
| 3,572,708 | 3/1971 | Schmid | 273/49 |
| 3,649,012 | 3/1972 | Zuercher | 273/49 |

FOREIGN PATENT DOCUMENTS

| | | | |
|---|---|---|---|
| 2127302 | 4/1984 | United Kingdom | 273/49 |

*Primary Examiner*—Anton O. Oechsle

*Attorney, Agent, or Firm*—Willian Brinks Olds Hofer Gilson & Lione

[57] ABSTRACT

A bowling ball return mechanism having a unitary frame structure which is mounted above a lifting track which curves upwards from the end of an underlane bowling ball return track up to the ball storage tray at the approach of the bowling alley. The unitary structure maintains the complete unit including a rotating tire with a compressable surface for positive engagement of an incoming bowling ball for movement up the lifting track, a rotating lifting belt which runs over the tire at one end and a crown pulley at the other for frictionally engaging the ball and moving it up the remaining length of the lifting track, an electric motor with a corresponding drive train for rotating the tire and the lifting belt, and a means for tensioning the lifting belt during its rotation. The unitary frame structure is pivotably mounted over the lifting track such that, upon engagement of the bowling ball by the tire, the structure will move away from its rest position and absorb the momentum of the moving ball. The weight of the mechanism causes a return pivot to the rest position while the tire and belt lift the bowling ball to the storage tray height.

6 Claims, 2 Drawing Figures

BOWLING BALL RETURN MECHANISM

This invention relates to a bowling ball return mechanism and particularly to apparatus for decelerating of a bowling ball which is returning from the pin end of the bowling alley on a track under the level of the lane and for the lifting the ball from this track to the storage tray located at the approach of the bowling alley.

The bowling industry has developed many automated systems for the game of bowling to shorten the time required to complete a typical game and to facilitate the ease of which a game is bowled. Such equipment consists generally of automated pin spotters, bowling ball accelerators, ball return mechanisms and automatic scoring apparatus. An important feature in all of these automated systems is speed of operation. The return of the bowling ball from the pin end to the approach of the bowling alley requires a high return rate of travel. A ball is accelerated during its return to the approach of the alley but must be delivered to the bowler at a safe speed and at a convenient height. This deceleration and lifting operation action is the function of a bowling ball return mechanism.

SUMMARY

A typical bowling ball return and lifting mechanism operates in conjunction with a track which extends from the pin end of the bowling alley or lane to the approach or bowler end of the alley. This track is usually run underneath the surface of the bowling lane. Also, for the convenience of the bowler the ball is lifted from this underlane track to a height which is easily accessible without a significant amount of bending by the bowler. For safety reasons the returning bowling ball is decelerated from its high return velocity to a rate that can be easily handled by the bowler.

Typical bowling ball return mechanisms are exemplified in U.S. Pat. Nos. 3,479,029 to Zuercher et al and 3,649,012 to Zuercher. These typical mechanisms are complex in their design and require a significant amount of floor space to be properly housed at the approach of a bowling alley.

A known disadvantage of typical bowling ball return mechanisms is created after a misfunction of the mechanism. If the return mechanism becomes inoperative, the lane must be closed and repairs performed. The complexity and the size of the typical unit requires that repairs be performed in their bowling alley position. Maintenance must also be accomplished in plain view of the customers and often requires the closing of additional lanes surrounding the inoperative mechanism. Additionally, since a portion of the operation of a return mechanism is located below floor surface, an opening in the bowling lane must be created in order to gain access to the return mechanism.

Another problem that typically arises during the operation of these type mechanisms occurs during the decleration of the incoming ball at the end of the underlane track. The deceleration portion of a typical mechanism requires a minimum input velocity of the ball to operate successfully. When a bowling ball is being returned from the pin end of the bowling lane it is usually accelerated by some means and returned down the underlane track. A mechanism slows the ball and delivers it to the lifting portion of the mechanism at a lower rate of speed. The speed reduction of the incoming ball usually occurs over some specific distance by the decleration device. If the incoming velocity of this ball is insufficient, the ball may become stopped completely during deceleration, or may be delivered at too low of a speed for the lifting mechanism to properly grip the ball. In either situation the bowling ball becomes jammed in the mechanism, usually in a location under the floor boards, and the flow of other incoming balls is stopped. The balls jam the underlane track and servicing by the bowling alley personnel is required.

It is the object of the present invention to overcome the problems of the known bowling ball return mechanisms.

In particular, it is the object of the present invention to provide a bowling ball deceleration and lifting mechanism which is easily accessible for repair, may be quickly repaired for continued operation and will function even upon return of the ball on the underlane track at a low velocity. These and other objects and advantages will become apparent by describing the preferred embodiment of the invention and particularly describing and distincly claiming its features.

Also, it is the object of this invention to provide a bowling ball return mechanism which may be repaired easily and as quickly as possible so that all lanes in a bowling complex may be operated to their maximum efficiency.

The preferred embodiment of this invention when operating in the bowling alley is mounted over the underlane track and raises the ball up to the storage tray height while simultaneously decelerating the ball. The operational elements of a complete mechanisms are mounted on a unitary frame structure which is attached to the return housing or the floor boards of the lane at a single pivot point.

In operation, the ball is initially met by a rotating tire and a continuous belt. The tire which is preferaly foam filled is compressed, when the ball contacts the rotating surface. Also, the frame structure is caused to pivot about its attachment point. The compression of the tire and the pivoting motion of the mechanism absorbs the impact of the incoming ball. The tire is rotated by an electric motor which is mounted on the frame and is driven by a combination of drive belts and pulleys. After absorbing the ball impact, the tire and its corresponding rotating continuous lifting belt, act to force the ball against a lifting track such that friction between the moving belt and the ball cause it to roll up a lifting track. The lifting track extends from the underlane track to the storage tray level within the housing.

All of the above described operational components are mounted on a unitary frame mounting within the housing. The preferred embodiment is lightweight and can be easily removed and replaced by another similar unit. The unitary structure allows a malfunctioning mechanism to be quickly removed from the housing and then transferred to another location in the bowling alley complex. The particular bowling alley may then continue to operate requiring only a minimum of shut down time to install a replacement mechanism. The malfunctioning unit is then repaired in a workshop or by an outside serviceman.

DETAILED DESCRIPTION

Figure 1:
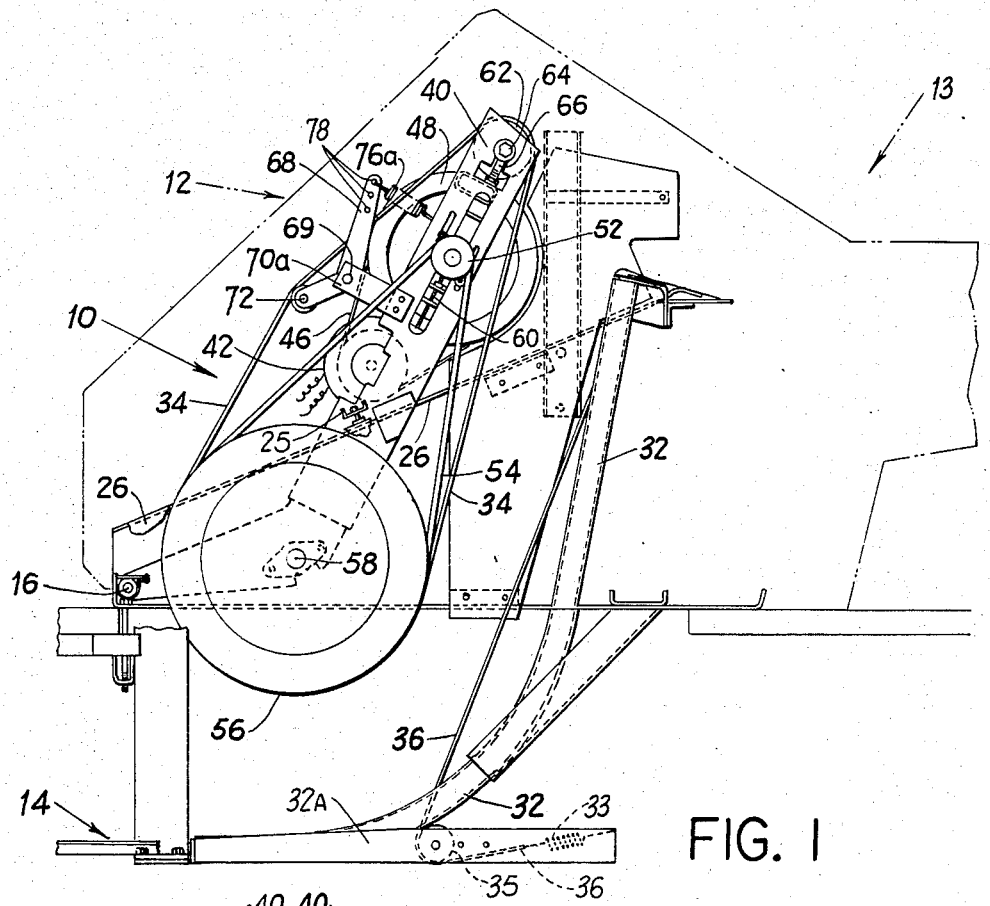
FIG. 1 is a side view of the invention mounted within a housing above the underlane return track.
Figure 2:
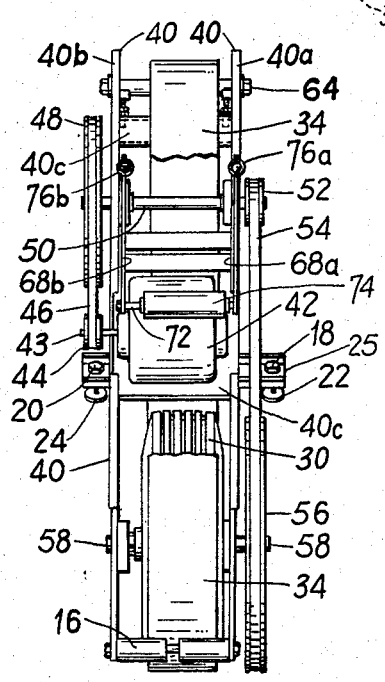
FIG. 2 is a front view of the invention with the lifting belt shown in section.

As seen in FIG. 1, the bowling ball return mechanism 10 is shown in a housing 12 and is mounted above the underlane track 14. The return mechanism 10 is fixed to the housing 26 at a pivot 16 and if free to rotate counterclockwise (as seen in FIG. 1) about this pivot 16. When in operation the mechanism 10 is supported on adjustable supports 18, 20 each having a shock absorbing bumper 22, 24 which normally rest on the housing frame 26. The adjustable supports 18, 20 are attached to the return mechanism 10 on bar 25 and maintain the return mechanism 10 at a height above the underlane track 14 such that an incoming bowling ball (not shown) will wedge under the tire 30. The tire 30 is compressible upon impact and is preferably filled with a foam rather than air. The use of foam is advantageous because the internal pressure of the tire is less likely to be diminished over long periods of operation.

The pivoting arrangement of the return mechanism 10 permits rotation of its entire structure in a clockwise direction (as seen in FIG. 1) about pivot 16. Upon engagement of the ball with the tire 30 the adjustable supports 18, 20 lift from the housing frame 26 and the mechanism absorbs the impact of the bowling ball which is normally incoming at a high speed. After absorbing the ball impact, the weight of the return mechanism 10 causes a returning rotation of the entire structure in a clockwise direction (again as seen in FIG. 1) about the pivot 16 back to its normal or rest position.

When the force of the incoming bowling ball traveling on the underlane track 14 is absorbed by the return mechanism 10, the bowling ball is wedged between the tire 30 and the lifting track 32. The tire 30 is rotating in a counterclockwise direction (in FIG. 1) and drives the ball up along the lifting track 32. The return mechanism 10 is also provided with a lifting belt 34 which is rotated by the tire 30. The lifting belt's 34 function is to drive the bowling ball up the remaining length of the lifting track 32 above the tire 30 to the height of the storage tray 13.

The lifting track 32 is provided with a spring tensioned stationary belt 36 whcih is tensioned between the track rails of the lifting track 32 by a spring 33 which is fixed to rail 32A and run around roller 35. This stationary belt 36 acts to bias the bowling ball against the lifting belt 34 as the ball-engaging span of lifting belt 34 is rotated. Also, the stationary belt is preferably made of leather so that any oil which may have accumulated on the ball will be removed. The lifting belt 34 is preferably made of a rubber base material to provide sufficient frictional contact with the bowling ball while also avoiding marking the its surface during the lifting operation.

All the components of the return mechanism 10 are mounted on a unitary frame structure 40 consisting of two "L" shaped members **40*a*, 40*b* and a plurality of cross members 40*c*. Rotation of the tire 30 is caused by an electric motor 42 mounted between members 40*a*, 40*b* in the center of the frame 40. The motor shaft 43 runs a drive pulley 44 which engages the first drive belt 46 and which in turn rotates a second pulley 48 along one side of the frame 40. The second pulley 48 is fixedly attached to a shaft 50 which is mounted for rotation on the frame 40. Shaft 50 extends through the frame 40 and terminates in a third pulley 52 on the opposite side of the frame 40. Third pulley 52, in turn, engages a second drive belt 54 which rotates a fourth pulley 56. Fourth pulley 56 is fixedly attached to axis 58 of tire 30. The rotation of the fourth pulley 56 also drives the tire 30**.

The tension in the first drive belt 46 and the second drive belt may be adjusted through mounting spacers 60. These mounting spacers 60 support shaft 50 on each side of frame members **40*a*, 40*b* and may be adjusted to vary the distance between the tire axis 58 and pulley 52 or the motor drive pulley 44 and the second pulley 48**.

The lifting belt 34 is wrapped around the tire 30 and extends along both sides of the frame 40 up to a crowned pulley 62. The crowned pulley 62 is mounted on a shaft 64 which extends between frame members **40*a*, 40*b*. The crown pulley shaft 64 is adjustable with respect to the tire axis 58 by a set of adjustment spacers 66 which support the pulley shaft 64 on the frame 40**.

The tension in the lifting belt 34 is controlled by a tensioning arm structure 68 located on the opposite side of the frame 40 from the ball lifting portion of the operation. This tensioning structure 68 comprises two pivoting arms **68*a*, 68*b* each of which is pivoted in the middle on a pin 69 on bracket 70*a* and 70*b* respectively. One end of each pivoting arm 68*a*, 68*b* is attached to a roller shaft 72 which extends between the two arms 68*a*, 68*b*. A roller 74 which supports the lifting belt 34 is mounted for rotation on the roller shaft 72. The opposite ends of the pivoting arm 68*a*, 68*b* are attached to the frame members 40*a*, 40*b* by tensioning springs 76*a*, 76*b*. As seen in FIG. 1 the pivot arms 68*a*, 68*b* are "V" shaped and pivoted at the pivot arm apex or pin 69 on brackets 70*a*, 70*b*. The tensioning springs 76*a*, 76*b* each pull one end of the respective pivot arms 68*a*, 68*b* towards its respective frame member 40*a*, 40*b*. The spring tension causes the opposite end of the pivot arm 68*a*, 68*b* to rotate about the pin 69 away from the frame 40 and tension the rotating lifting belt 34. The pivot arms 68*a*, 68*b* are provided with a series of attachment holes 78 (three shown) for adjustment of the tension in the lifting belt 34. Each attachment hole 78 is placed on a different location along the pivoting arm 68*a*, 68*b* with respect to the pin 69 pivot. The tensioning springs 76 can be placed on any one of these attachment locaions 78 for variation in the amount of tension placed on the lifting belt 34. Also, smaller adjustments of the belt 34 tension can be performed by adjusting the mounting spacers 66**.

The design of the housing 12 and the placement of the return mechanism 10 therein is such that initially the rotation of the tire 30 causes the bowling ball to run up the lifting track 32. The tire 30 surface is compressible for aiding in the gripping of the ball at any incoming velocity. After reaching a height on the lifting track 32 above the tire 30, the tensioned lifting belt 34 moves the ball up the remaining stretch of the lifting track. The combination of tension in the stationary belt 36 and in the rotating lifting belt 34 provides a sufficient frictional support of the bowling ball to move it to the top of the lifting track 32. When the ball reaches the top of the lifting track 32 it is transferred away from the return mechanism 10 out of the housing 12 and onto the storage tray 13 all at a safe speed.

Having described the nature of the invention, its desired operational functions and advantages and its preferred embodiment, what is claimed is:

1. Bowling ball return apparatus adapted for mounting within the housing of a ball storage tray which is located at the bowler end of a bowling lane and adapted to receive a bowling ball returned on a ball return track from the pin deck end of the lane and to lift the ball upwardly onto the storage tray for pick up by a bowler, the combination comprising an inclined frame adapted to be pivotally supported at its lower end within said housing compressible tire means rotatably supported on the lower portion of the frame in spaced relationship to its pivot end and adapted to be placed partially in the path of a bowling ball returning on said track from the pin deck, roller means supported on the upper portion of said frame adjacent the end opposite the pivot end, an endless belt passing around the tire means and said roller means and having an inclined ball-engaging span, means for rotating said tire, said belt and roller, said frame being positionable within the housing to normally rotatably support the tire means partially in the path of a ball returning from the pin deck end and beyond the pivot means in the direction of travel of the ball so that a returning ball is wedged under the belt and rotating compressible tire means and said frame pivots away from a returning ball to absorb the impact of the ball and to roll the ball under the tire means and onto the inclined ball-engaging span of the belt, said ball-engaging span of the endless belt adapted to be placed in spaced relation to an inclined ball lifting means a sufficient distance to cause the ball to be frictionally engaged with the belt and roll up the ball lifting means, said roller means being positionable adjacent the storage tray, whereby balls rolled up the inclined ball lifting means are rolled onto the storage tray.

2. The bowling ball return apparatus claimed in claim 1 wherein said ball lifting means is a lifting track in communication with the return ball track and is curved upwardly over at least a portion of its extent to elevate a ball above the return ball track after the tire means with the belt therearound makes contact with a ball, said lifting track continuing from said curved extent to extend adjacent the ball-engaging span of the belt, whereby the ball rolls up the lifting track in response to the rotating belt.

3. The bowling ball return apparatus claimed in claim 2 wherein a returning bowling ball engages said rotating tire with the endless belt thereon before it encounters the inclined ball lifting means.

4. The bowling ball return apparatus claimed in claim 1 and including pivot support and securing means at the lower end of the inclined frame for pivotally securing the frame relative to the housing, the frame being secured at no other place, thereby permitting easy removal and repair of the ball return apparatus.

5. The bowling ball return apparatus claimed in claim 1 wherein said ball lifting means includes a spring tensioned belt means positioned to engage a ball on the inclined ball lifting means to help urge the ball into contact with the rotating endless belt.

6. The apparatus claimed in claim 5 wherein said spring tensioned belt is made of a material that tends to remove oil that accumulates on a bowling ball.

* * * * *